US011834949B2

(12) United States Patent
Guo et al.

(10) Patent No.: US 11,834,949 B2
(45) Date of Patent: Dec. 5, 2023

(54) COLLABORATIVE EROSION-CONTROL METHOD OF RELEASING-SPLITTING-SUPPORTING BASED ON COAL MASS PRESSURE RELIEF AND ROOF PRE-SPLITTING

(71) Applicant: SHANDONG UNIVERSITY OF SCIENCE AND TECHNOLOGY, Qingdao (CN)

(72) Inventors: Weiyao Guo, Qingdao (CN); Lexin Chen, Qingdao (CN); Yan Tan, Qingdao (CN); Yunliang Tan, Qingdao (CN); Tongbin Zhao, Qingdao (CN)

(73) Assignee: SHANDONG UNIVERSITY OF SCIENCE AND TECHNOLOGY, Qingdao (CN)

( * ) Notice: Subject to any disclaimer, the term of this patent is extended or adjusted under 35 U.S.C. 154(b) by 0 days.

(21) Appl. No.: 18/178,385

(22) Filed: Mar. 3, 2023

(65) Prior Publication Data

US 2023/0340878 A1 Oct. 26, 2023

Related U.S. Application Data

(63) Continuation of application No. PCT/CN2022/104933, filed on Jul. 11, 2022.

(30) Foreign Application Priority Data

Apr. 22, 2022 (CN) ..... 202210430152.X

(51) Int. Cl.

| | |
|---|---|
| ***E21C 41/18*** | (2006.01) |
| ***E21D 21/02*** | (2006.01) |
| ***E21D 20/00*** | (2006.01) |

(52) U.S. Cl.

CPC ..... *E21C 41/18* (2013.01); *E21D 20/00* (2013.01); *E21D 21/02* (2013.01)

(58) Field of Classification Search

CPC . E21F 1/04; E21C 41/18; E21D 20/00; E21D 21/02

See application file for complete search history.

(56) References Cited

U.S. PATENT DOCUMENTS

2020/0040727 A1 2/2020 Miao

FOREIGN PATENT DOCUMENTS

AU 2021106168 A4 10/2021
CN 102220866 A 10/2011
(Continued)

OTHER PUBLICATIONS

Li Shijin et al. "Study on technology of driving and anti rockburst in deep and extra thick seam of Zhangshuanglou Coal Mine", Feb. 25, 2020, No. 1, ISSN:1008-3731, p. 83-85, Section 2-4.

*Primary Examiner* — Janine M Kreck

(57) ABSTRACT

A collaborative erosion-control method of releasing-splitting-supporting based on coal mass pressure relief and roof pre-splitting provided by the disclosure includes the following steps: step 1, driving into a coal seam to release pressure; step 2, low roof pre-splitting during driving process; step 3, supporting of roadway surrounding rock and support reinforcement; step 4, floor destressing of the roadway; step 5, high roof pre-splitting before mining; step 6, destressing and supporting of the advanced roadway surrounding rock during the mining process of the working face. The collaborative erosion-control method of releasing-splitting-supporting based on coal mass pressure relief and roof pre-splitting, and to carry out local pressure relief, roof pre-splitting and reinforcement support construction in the whole cycle of the (Continued)

coal working face in a progressive manner, so as to achieve the prevention and control of rock burst in the working face.

2 Claims, 9 Drawing Sheets

(56) References Cited

FOREIGN PATENT DOCUMENTS

| | | | |
|---|---|---|---|
| CN | 104763425 | A | 7/2015 |
| CN | 109826628 | A | 5/2019 |
| CN | 110173264 | A | 8/2019 |
| CN | 110700883 | A | 1/2020 |
| CN | 111608663 | A | 9/2020 |
| CN | 111720139 | A | 9/2020 |
| CN | 112282806 | A | 1/2021 |
| CN | 112832768 | A | 5/2021 |
| CN | 113107490 | A | 7/2021 |

COLLABORATIVE EROSION-CONTROL METHOD OF RELEASING-SPLITTING-SUPPORTING BASED ON COAL MASS PRESSURE RELIEF AND ROOF PRE-SPLITTING

CROSS-REFERENCE TO RELATED APPLICATIONS

This application is a continuation of International Application No. PCT/CN2022/104933 with a filling date of Jul. 11, 2022, designating the United states, and further claims to the benefit of priority from Chinese Application No. 202210430152.X with a filing date of Apr. 22, 2022. The content of the aforementioned applications, including any intervening amendments thereto, are incorporated herein by reference.

TECHNICAL FIELD

The disclosure relates to the technical field of coal mine rock burst prevention and control, in particular to a collaborative erosion-control method of releasing-splitting-supporting based on coal mass pressure relief and roof pre-splitting.

BACKGROUND

As a typical coal mine dynamic disaster, rock burst seriously threatens the safe production and operation of the mine. With the increase of coal mining intensity and depth, the occurrence frequency of rock burst increases significantly. Statistics show that the number of rock burst in the roadway accounts for nearly 90% of the total number of rock burst. In order to solve the problem of roadway rock burst, various prevention and control technologies have emerged as the times require. The prevention and control technology of rock burst mainly includes local pressure relief (including drilling pressure relief, drilling-blasting, coal seam water injection, roof pre-splitting and floor blasting, etc.) and reinforcement support (including anchor bolt, anchor cable, anchor bolt-grouting and composite support, etc.). In order to reconcile the contradiction between local pressure relief and reinforcement support in weakening and strengthening the bearing capacity of surrounding rock, the new idea of erosion-control based on the concept of "releasing-supporting" coupling provides a feasible and effective way for the prevention and control of roadway rock burst.

At present, the erosion-control method based on the concept of "releasing-support" coupling, although the pressure relief and reinforcement are considered as a whole, does not take into account the hard roof, the main impact factor of rock burst. However, most of the occurrence of rock burst is mainly affected by the overburden hard roof on the working face, and the existing research shows that the roof and floor, as a high energy storage structure, play a role in promoting the formation and occurrence of rock burst in the roadway.

SUMMARY

The object of the present disclosure is to provide a collaborative erosion-control method of releasing-splitting-supporting based on coal mass pressure relief and roof pre-splitting, and to carry out local pressure relief, roof pre-splitting and reinforcement support construction in the whole cycle of the coal working face in a progressive manner, so as to achieve the prevention and control of rock burst in the working face.

In order to achieve the above object, the technical solution adopted by the disclosure is as follows:

A collaborative erosion-control method of releasing-splitting-supporting based on coal mass pressure relief and roof pre-splitting, which includes the following steps.

Step 1, Driving into the coal seam to release the pressure.

Step 11. During the cyclic driving construction of roadway of the working face, 1-3 pressure relief holes are constructed in the roadway of the driving face according to the rock burst hazard level of the working face with each round of driving construction. The pressure relief holes are 0.5-1.5 m from the floor, the diameter of the pressure relief hole is 100-300 mm, and the depth of which is the sum of the driving planned drilling depth and the distance between the peak value of the bearing pressure of the driving face and the coal wall; the pressure relief holes are constructed in the side of roadway within 20 m behind the driving face, the distance between the adjacent pressure relief holes is 1-3 m, the diameter of the pressure relief hole is 100-300 mm, the depth of the pressure relief hole is 15-45 m, and the height of the pressure relief hole from the floor is 1.0-1.5 m.

Wherein, in the region with weak rock burst hazard level, one pressure relief hole is constructed in the driving face; in the region with medium and strong rock burst hazard level, 2-3 pressure relief holes are constructed in the driving face.

Step 12. In the roadway section in the region with strong rock burst hazard level, the roadway section with the side of roadway of the displacement of 10-20 mm or the roadway section with reduced anchor bolt support strength, the sectional destress drilling is carried out. The distance of the pressure relief holes is 1-3 m, the depth of the pressure relief holes is 15-45 m, the diameter of the pressure relief holes in the 0-5 m section is 70-100 mm, and the diameter of the pressure relief holes in the 5-45 m section is 150-300 mm;

Step 13. Before the next round of construction, a grouting anchor bolt is constructed between the two adjacent pressure relief holes on the side of roadway. The grouting anchor bolt is provided with a stress meter, and the stress meter monitors the stress of the grouting anchor bolt in real time. When the stress of the grouting anchor bolt decreases to 80%, the grouting anchor bolt is replaced.

Step 14. Drill cuttings monitoring is carried out to obtain the drilling powder rate index on two sides of the pressure relief hole of the two sides of roadway of the coal mass to determine the pressure-relief effect. If the drilling powder rate index is greater than 1.5, it is still has the risk of rock burst, then densify the pressure relief hole to release the pressure on the two sides of the roadway of coal mass again until the drilling powder rate index is less than 1.5. When densifying the pressure relief hole, the drill holes in the two sides of the roadway are perpendicular to the axial direction of the roadway. The diameter of the drill holes is 42-100 mm, the distance between the drill holes is 5-20 m, and the depth of the drill holes is the distance from the peak point of the stress concentration zone to the coal wall.

Step 2. Low roof pre-splitting during driving.

Step 21. In the process of driving roadway, the drill cuttings monitoring is carried on within 100 m from the driving face. The depth of drill hole of the drill cuttings monitoring is not less than 15 m, and the distance between the drill holes is 10-25 m. The equivalent stress contour map and equivalent stress distribution pattern map are drawn according to the amount of pulverized coal corresponding to different drilling depths.

Step 22. Selecting step a or step b to carry out roof pre-splitting construction.

Step a. Blasting pre-splitting.

Step a1. Determining the position of charge section of the roof pre-splitting.

Record that the distance between the equivalent stress peak of the two sides of the roadway in the far distance and the coal wall is $p_x$ meters, draw the peak stress line of the two sides of the roadway on the equivalent stress contour map in step 21, and record the range of the stress peak region of 0.95 $p_x$-$p_x$ meters from the coal wall as a, that is, the stress stability region; record the range 1.0-1.3 m from the peak stress line of the two sides of the roadway as b; the range obtained from the intersection of a and b is the projection of the charge section of the roof pre-splitting on the horizontal, so as to determine the position of the charge section of the roof pre-splitting.

Step a2. Determining the angle of blasting drillhole and the position of target rock layer of pre-splitting roof.

According to the vertical distance h from the bottom of the hole of the charge section to the coal seam and the horizontal distance 1 from the side of roadway, the elevation angle of blasting drillhole is determined;

Then the elevation angle of blasting drillhole is:

$$\theta=\arctan(h/l);$$

In the formula,

In consideration of the influence of dynamic load generated by roof blasting on the stability of coal mass in the side of the roadway, h is taken as 5-7 m;

$$l=(p_x-1.3);$$

Step a3. Arrangement of blasting drillhole.

At the roadway location where the stress stability region is located, the blasting drillhole is carried out from the shoulder angle positions of the two sides of the roadway to the roof. The distance of the blast holes is 5-20 m, and the charge quantity of the blasting drillhole shall achieve the effect of loosening the rock mass without causing the collapse of the rock mass.

Step a4: Detonating the explosive charges in the blasting drillhole.

Step b. Hydraulic pre-splitting.

According to the equivalent stress distribution pattern map in Step 21, the position with the highest amount of pulverized coal is determined as the bearing pressure peak position of the sides of roadway, and hydraulic drillholes are constructed from the shoulder angle positions of the two sides to the roof.

Wherein, the horizontal distance of hydraulic drillholes exceeds 1-2 m over the bearing pressure peak position of the sides of roadway, which is recorded as $l_r$; the vertical distance from the hydraulic drillholes to the coal seam is 3-5 m, which is recorded as $h_r$; then the dip angle of hydraulic drillholes is: $\theta=\arctan(h_r/l_r)$.

The water injection equipment is connected with the hydraulic drillholes through the water injection pipeline.

The water injection equipment is used to inject water into the hydraulic drillholes. When water seeps out of the roadway roof, the side of roadway or during hydraulic drillholes, the hydraulic pre-splitting is completed.

Step 3: Roadway surrounding rock support and support reinforcement.

Step 31. During the driving process, when the roadway is driven to the section roof and the two sides of the roadway, anchor bolts, anchor bolt cables, ladder beams and steel bands are used for support. The length of the anchor bolts is 1.8-2.4 m, the distance between the anchor bolts is 800-1200 mm, and the row spacing is 800-1200 mm; the anchor bolt cable is installed immediately following the construction of the driving face, with the distance of 800-1200 mm and the row spacing of 800-1200 mm; the beam spacing between the ladder beams is 2000 mm; the length of steel beam is 4000 mm, and the band spacing is 2000 mm.

Step 32. Conducting monitor to the roadway displacement or anchor bolt stress in real time. For roadway sections where the displacement of two sides increases by more than 10% or the anchor bolt stress decreases by more than 10%, the anchor bolt is used for grouting reinforcement within 0-3 m from the coal wall, and the anchor bolt cable is used for reinforcement; for the roadway section where the displacement of the two sides increases by less than 10% or the anchor bolt stress decreases by less than 10%, the anchor bolt is used for grouting reinforcement within 0-3 m from the coal wall.

Step 33. After the roof pre-splitting, in the middle of the two sides of the roadway, the amount of pulverized coal corresponding to different drilling depths is obtained by monitoring the drilling cuttings to draw the equivalent stress distribution pattern map; according to the equivalent stress distribution pattern map, the position where the amount of pulverized coal is reduced is determined as the bearing pressure reduction position of coal seam, the position where the amount of pulverized coal is maximum is determined as the bearing pressure peak position of coal seam, and the second stress peak in the depth of the coal seam is determined as the high stress elastic bearing region of the coal mass.

Step 34. By adopting anchor bolt reinforcement solution to support and reinforce the side of roadway. The length of the anchor bolt ensures that the anchor fixed section is located in the high stress elastic bearing region of the coal mass, and the reinforcement length of the anchor bolt at least exceeds 2.0 m over the bearing pressure peak position of the coal seam.

Step 4: Roadway floor destressing.

Step 41. In the roadway section with weak rock burst hazard level, the pressure relief hole with an angle of 45° to the horizontal direction is drilled from the bottom corner of the roadway floor towards the two sides of the roadway. The diameter of pressure relief holes is 70-150 mm, and the row spacing between pressure relief holes is 1-3 m. In the roadway section with medium rock burst hazard level, the pressure relief hole with an angle of 45° to the horizontal direction is drilled from the bottom corner of the roadway floor towards the two sides of the roadway. The diameter of the pressure relief hole is 70-150 mm, and the row spacing between the pressure relief holes is 1-3 m. Hydraulic fracturing is carried out for the weak rock stratum of the floor, and grouting is carried out for the section 1-3 m from the floor in the drillhole. In the roadway section with strong rock burst hazard level, blast holes are drilled from the bottom corner of the roadway floor towards the two sides of the roadway. The diameter of the blast holes is 50-70 mm, and the row spacing between the blast holes is 3-5 m. Blasting treatment is carried out on the weak rock stratum of the floor, and grouting is carried out on the section 1-3 m from the floor in the blast hole.

Step 42. The drilling cuttings monitoring is used as the main method and the microseismic index method as the auxiliary method to detect the floor pressure of the roadway floor; if the destressing is not good after testing, the roadway floor shall be destressed again; specifically, if the difference between the bottom plate ground pressure detection result and the normal value is less than 5%, the pressure relief hole shall be densified; if the difference is greater than 5% and less than 10%, the relief hole shall be densified or the blast hole shall be drilled into the floor between the original pressure relief holes for blasting treatment; if the difference is greater than 10%, the blasting holes shall be drilled into the floor at an interval of 3-5 m between the original pressure relief holes and the middle position of the roadway floor for blasting treatment.

Step 5. High roof pre-splitting before mining.

Step 51. After the mining of the roadway driving is completed and before the mining of the working face, the roof pre-splitting is carried out on the overburden hard roof covered on the front and sides of the open-off cut of the working face; selecting the overburden hard roof with a thickness of more than 5 m and a strength index of D>120 within 100 m from the immediate roof as the rock stratum for pre-splitting;

Step 52. Selecting step c or step d for blast hole layout

Step c. If the working face is a primary working face, drill a blast hole with an angle of 70-75° to the horizontal line from the shoulder angle of the two sides of the roadway towards the direction of the working face; wherein the distance from the end of the blast hole to the coal seam is the sum of the thickness of the rock stratum for pre-splitting and the distance from the roof to the coal seam, and the row spacing of the blast hole is 10-20 m.

Step d. If the working face is goaf on one side, in addition to step c, in the roadway on the side adjacent to the goaf, step e or step f is selected for roof pre-splitting construction:

Step e. Drilling the blast hole with an angle of 70-75° to the horizontal towards the direction of the goaf; the distance from the end of the blast hole to the coal seam is the sum of the thickness of the rock stratum for pre-splitting and the distance from the roof to the coal seam, and the row spacing of the blast hole is 10-20 m.

Step f Using hydraulic fracturing to pre-split the roof at the side of the coal pillar in the goaf. The diameter of the hydraulic drillholes is 56 mm, the length of the hydraulic drillholes is 30 m, the spacing of the hydraulic drillholes is 15-30 m, the angle between the horizontal projection of the hydraulic drillholes and the coal wall is 75°, and the elevation angle of the hydraulic drillholes is 50°; the water injection equipment is connected with the hydraulic drillholes through the water injection pipeline, and the water injection equipment is used to inject water into the hydraulic drillholes. When water seeps out of the roadway roof, roadway side or hydraulic drillholes, the hydraulic pre-splitting is completed.

Step 6. The pressure relief and support of the advanced roadway surrounding rock during the mining process of the working face.

Step 61. Constructing the pressure relief holes in the coal mass within at least 200 m of the advance working face on two sides of the roadway. The pressure relief hole is constructed towards the coal mass at the open-off cut of the working face, and the depth of the pressure relief hole is the sum of the planned drilling depth of the working face and the distance from the bearing pressure peak position to the coal wall.

Step 62. Roof pre-splitting during the mining process of the working face.

In the mining process of the working face, in order to reduce the fracture energy release of the overburden hard roof, within the range of 100 m in advance of the working face, blast holes are constructed at an interval of 20-30 m from the shoulder angle of the roadway to the coal mass to conduct blasting pre-splitting. The blast holes are arranged in a fan pattern and the range of elevation angle of the blast holes is 30-70°.

Step 63. Calculation of roof breaking impact energy

The impact energy generated by roof breaking is:

$$\Delta U_w = \frac{q^2 L^5}{8k^3 EI};$$

In the formula, q is the uniformly distributed load of the overburden rock stratum; L is the span of roof stratum, which is approximately the pre-splitting interval; k is the weakening coefficient of the inertia moment of the roof end face, wherein $$k = \frac{a+b}{l},$$

a and b are the length of the pre-splitting zone at the upper and lower boundaries of the roof respectively, and l is the length of the working face inclination; E is the elastic modulus of roof stratum; I is the inertia moment of the roof end face without pre-splitting.

Step 64. Advance support of roof and two sides of the roadway during the mining process of the working face.

The roof of the roadway adopts hydraulic props for advance support, and the two sides of the roadway adopt anchor bolts for advance reinforcement support;

$$P_z > \frac{\alpha \Delta U_w - an_g \int_{P_{g0}}^{P_{gm}} P_g dl_g - an_s \int_{P_{0s}}^{P_{sm}} P_s dl_s}{bnl_i};$$

In the formula, $P_z$ is the support strength of a single hydraulic prop in advance of the working face, kN/m; α is the energy attenuation coefficient; α is the advance support range of roadway, m; b is the roadway width, m; n is the total number of hydraulic props in the advance region; $n_g$ and $n_s$ are the number of existing anchor bolts and anchor cables on the roof of the roadway per unit length; $l_i$ is the maximum compressed amount of a single hydraulic prop; $P_g$ and $P_s$ are the supporting forces of the existing roof anchor bolts and anchor cables; $P_{gm}$ and $P_{sm}$ are the breaking forces of the existing roof anchor bolts and anchor cables; $P_{g0}$ and $P_{s0}$ are the current support forces of existing roof anchor bolts and anchor cables.

$$P_m > \frac{\alpha \Delta U_w - an_g \int_{P_{g0}}^{P_{gm}} P_g dl_g - an_s \int_{P_{s0}}^{P_{sm}} P_s dl_s}{bnl_i};$$

In the formula, $P_m$ is the support strength of single anchor bolt ahead of the working face, kN/m; $n_g$ and $n_s$ are the number of existing anchor bolts and anchor cables at the side of the roadway per unit length; n is the number of anchor bolts at the side of the roadway per unit length; $P_g$ and $P_s$ are the supporting forces of the existing anchor bolts and anchor cables on the side of the roadway; $P_{gm}$ and $P_{sm}$ are the breaking forces of the existing anchor bolts and cables in the side of the roadway; $P_{g0}$ and $P_{s0}$ are the current support forces of existing anchor bolts and anchor cables in the side of the roadway.

Preferably, the comprehensive index method is used to determine the rock burst hazard level. If the rock burst hazard index is less than 0.25, it is defined as no rock burst hazard; if the rock burst hazard index is greater than or equal to 0.25 and less than 0.5, it is defined as weak; if the rock burst hazard index is greater than or equal to 0.5 and less than or equal to 0.75, it is defined as the medium rock burst hazard level; If the rock burst hazard index is greater than 0.75, it is defined as the strong rock burst hazard level.

Preferably, the drill cuttings monitoring process is as follows:

The drillholes with a diameter of 40-50 mm and vertical to the coal mass in the side of the roadway are drilled, the amount of pulverized coal drilled at each set depth is collected, weighed and recorded.

The advantageous technical effects of the disclosure are as following:

1. By pre-splitting the roof stratum of different targets directly, the disclosure depressurizes the two sides of the roadway while releasing the roof strain energy, reducing the stress concentration coefficient of the two sides of the coal mass, which is conducive to the roof collapse in the mining process. Compared with the coal seam blasting method, the roof pre-splitting method of the low near-field roof can ensure the bearing capacity of the coal, at the same time, make the coal seam stress transfer to a deeper depth, give play to the characteristics of the high bearing capacity of the deep coal, and effectively reduce the probability of rock burst.
2. The disclosure carries out the open-off cut position and lateral roof pre-splitting in the roadway before mining, while preventing the rock burst of the driving face, it plays a beneficial role in the collapse of the hard roof during the mining process of the working face, and can effectively prevent the large region roof collapse from causing strong impact energy. At the same time, the roof pre-splitting method is advance of the mining of the working face in time, avoiding the superposition of engineering disturbance and mining disturbance of the roof pre-splitting, and significantly reducing the control work of rock burst disaster prevention measures in the mining process.
3. On the basis of sectional drilling and pressure relief for the two sides of the coal, the disclosure carries out roof pre-splitting, which can fully reduce the stress concentration of the two sides of the coal mass, release the strain energy stored in the coal mass, and ensure the support capacity of the anchor bolt and the integrity and bearing capacity of the coal mass near the roadway.
4. By monitoring the stress distribution of the coal seam, using the pressure relief technology to transfer the bearing pressure and the high strength of the deep coal mass, the disclosure anchors the two sides of the coal mass, which can achieve better anchoring effect and improve the impact resistance of the two sides of the coal mass. The equivalent end face inertia moment weakening coefficient is used to calculate the impact energy when the pre-split roof collapses, so as to carry out advance support for the working face of roadway.
5. The disclosure integrates the existing technical elements to control the rock burst risk factors of surrounding rock roof and coal seam, and has the characteristics of simple and easy operation and convenient construction.

DETAILED DESCRIPTION OF THE EMBODIMENTS

Figure 1:
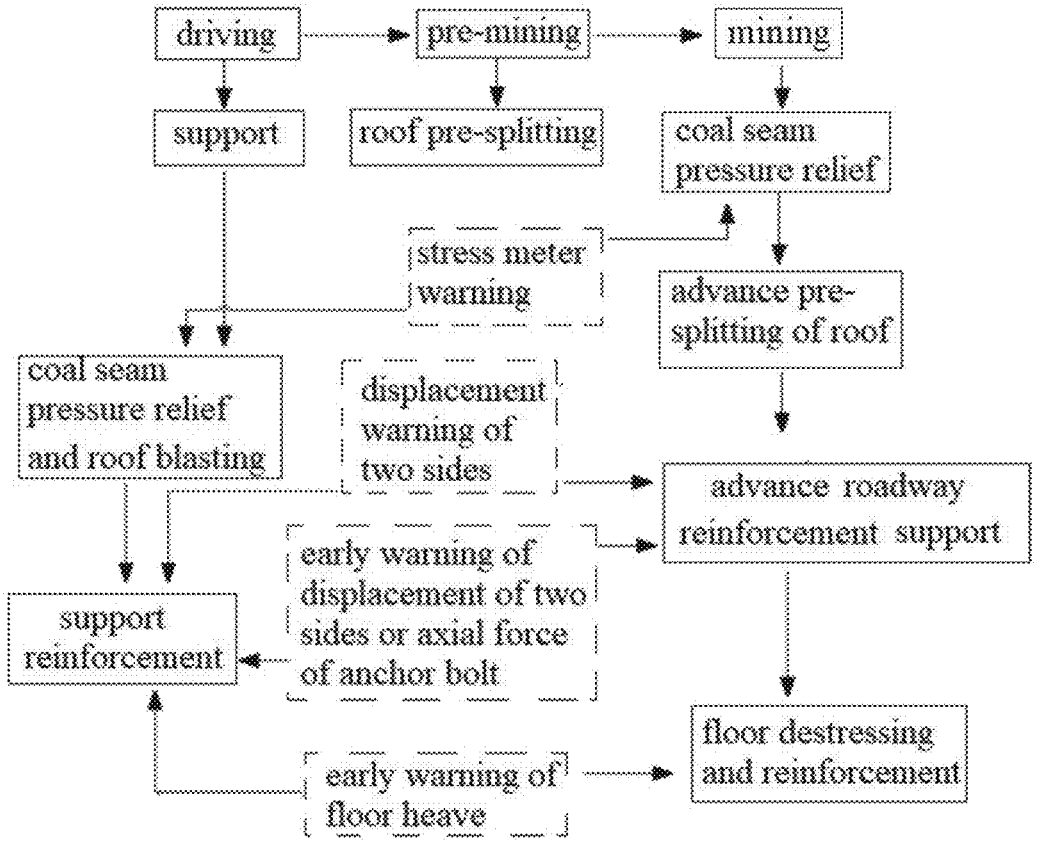
FIG. 1 is a flowchart of an embodiment of the disclosure.
Figure 2:
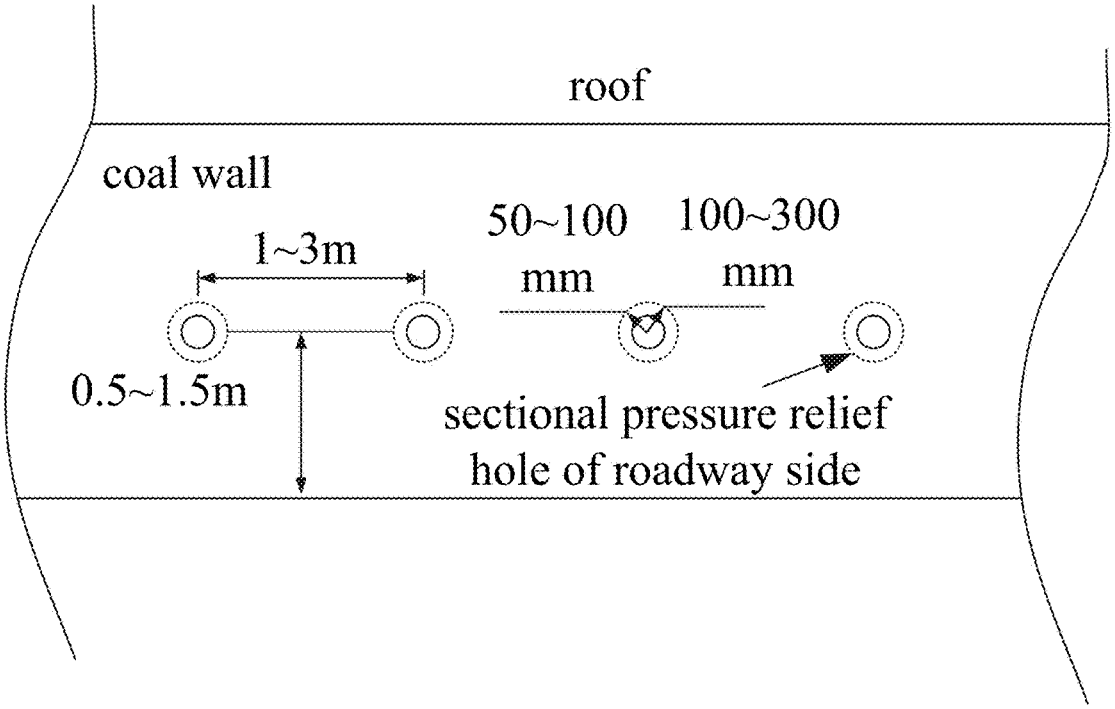
FIG. 2 shows the layout of the coal seam pressure relief drilling and sectional reaming in the embodiment of the disclosure.
Figure 3:
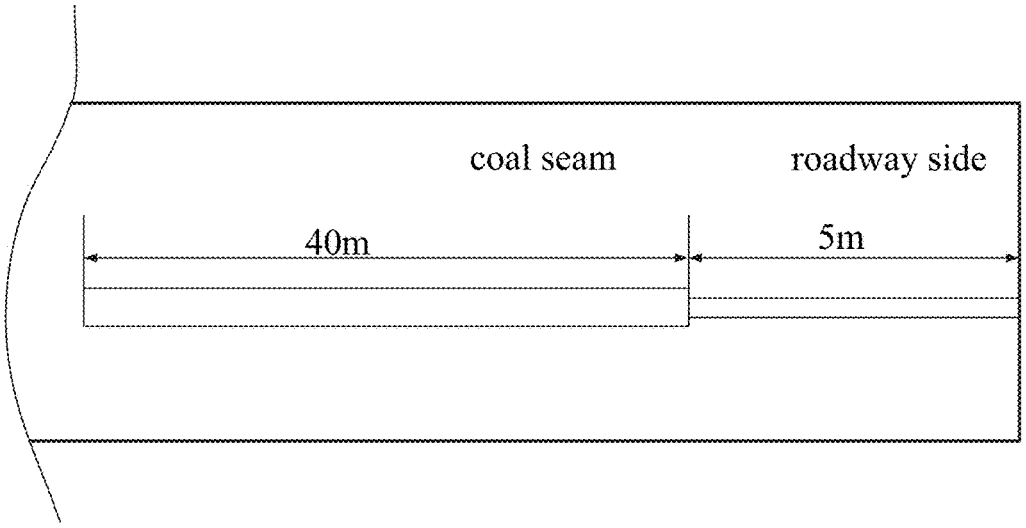
FIG. 3 is the layout of the sectional reaming in the coal seam of the embodiment of the disclosure.
Figure 4:
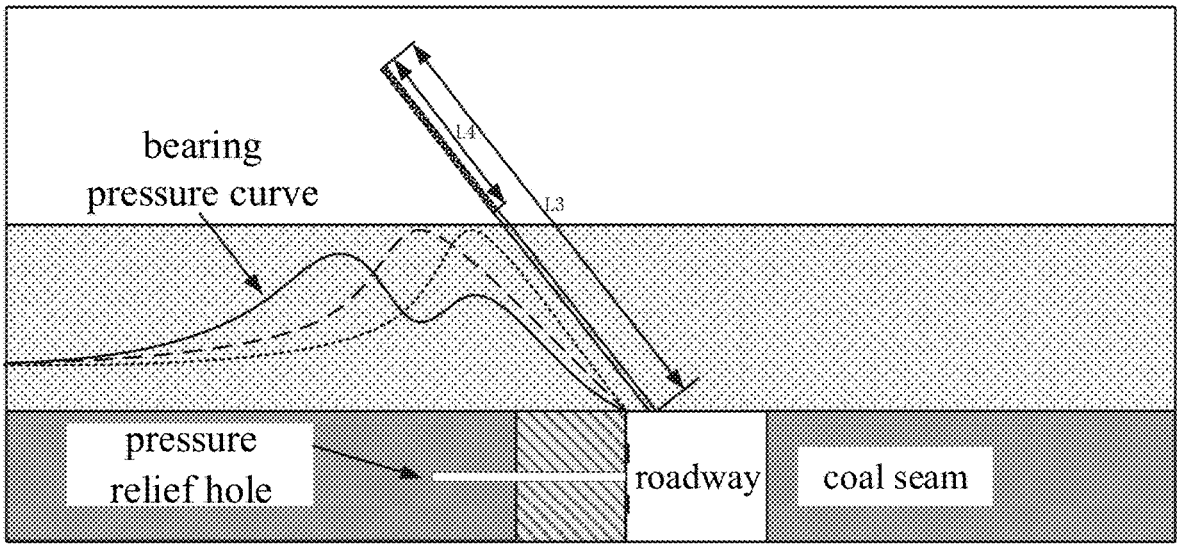
FIG. 4 is the schematic diagram of near-field roof pre-splitting and pressure relief in the embodiment of the disclosure.
Figure 5:
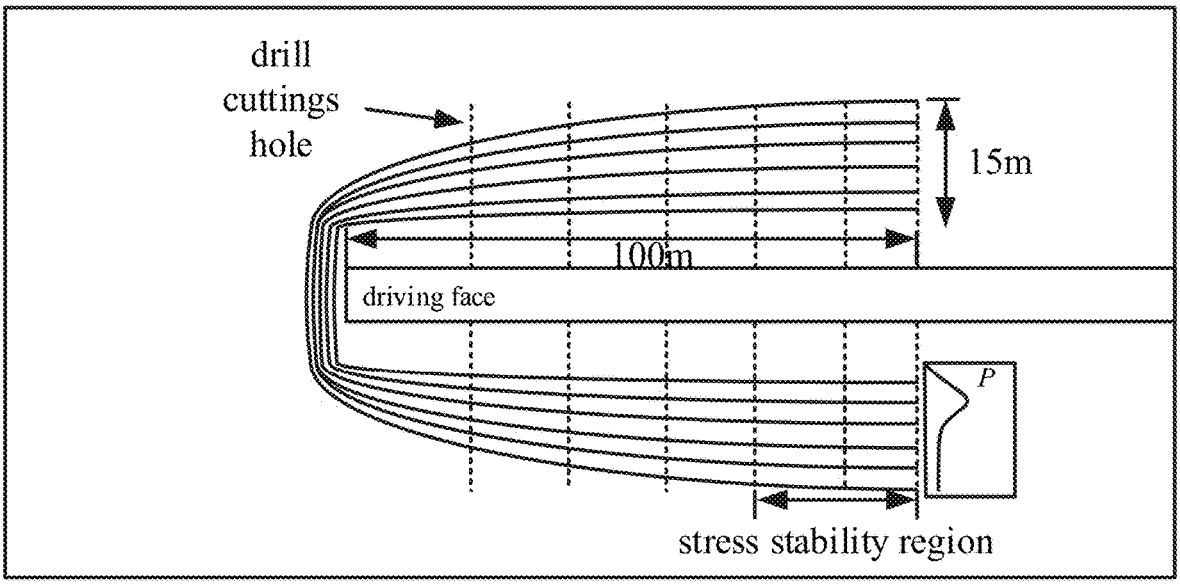
FIG. 5 is the plane diagram of equivalent stress of drill cuttings at two sides of the roadway in the driving process of the embodiment of the disclosure.
Figure 6:
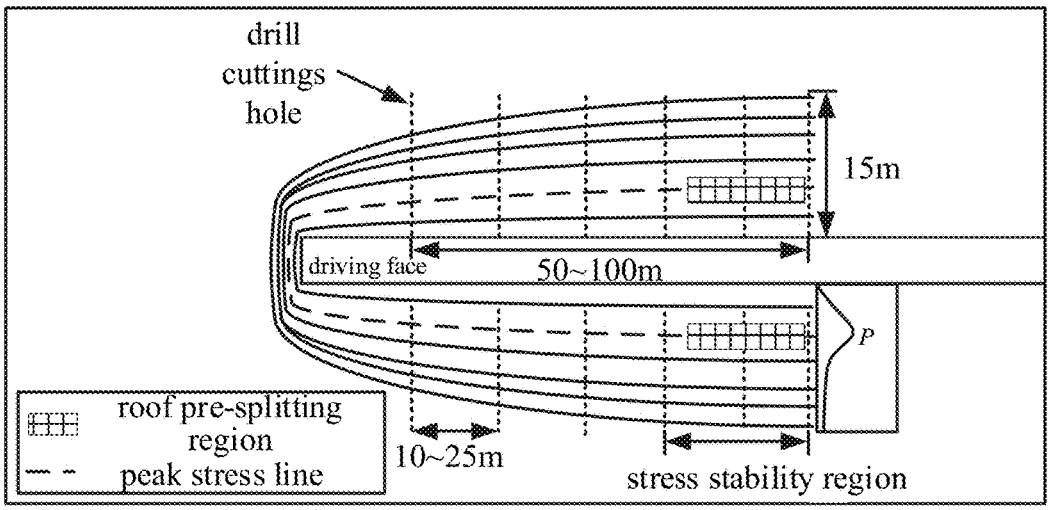
FIG. 6 is the plan diagram of delineation of the roof pre-splitting region during the driving process of the embodiment of the disclosure.
Figure 7:
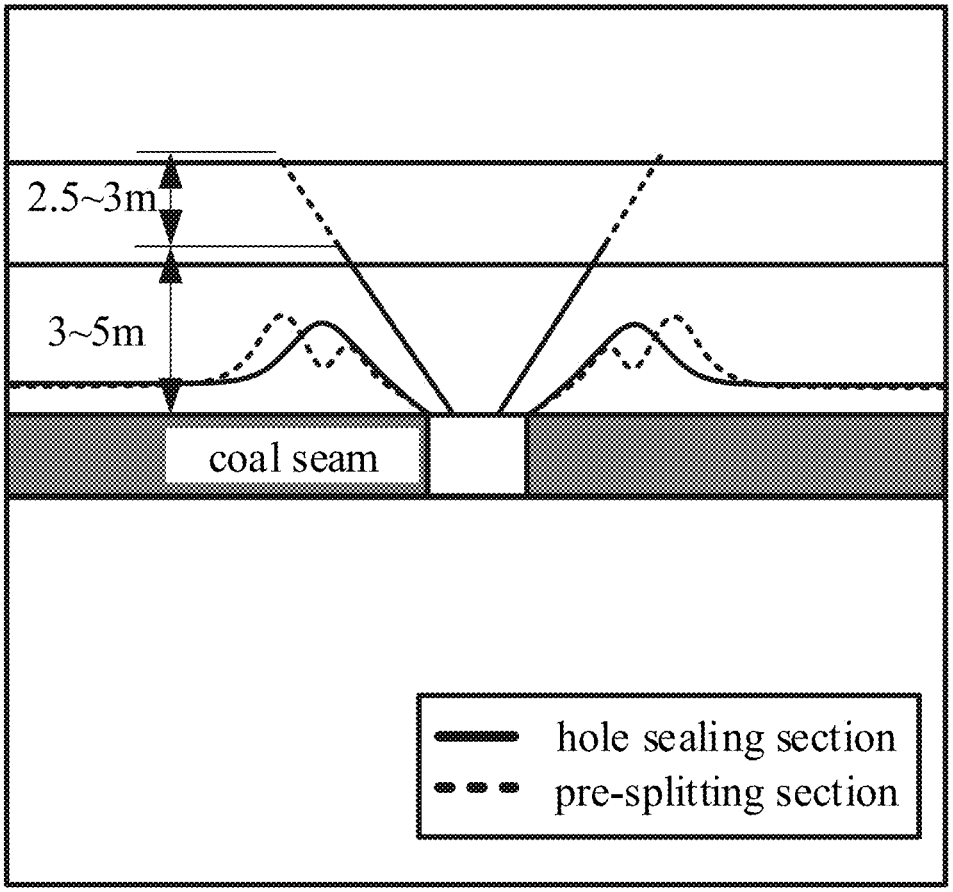
FIG. 7 is the section diagram of delineation of the roof pre-splitting region during the driving process of the embodiment of the disclosure.
Figure 8:
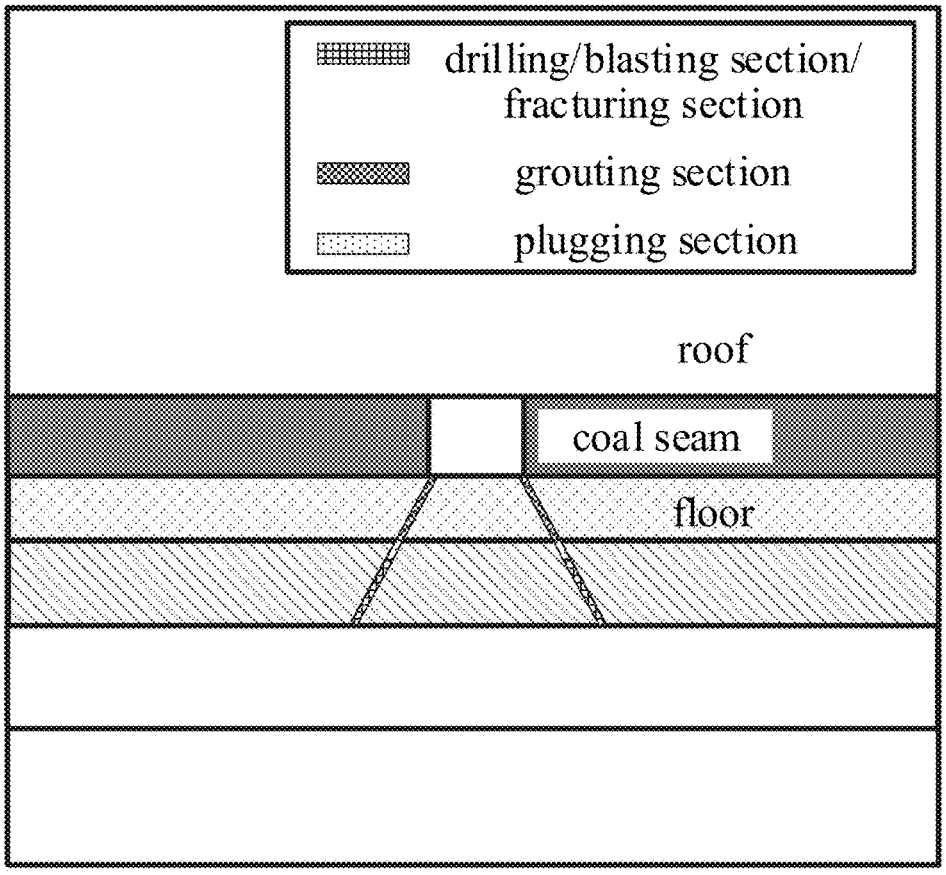
FIG. 8 is the section diagram of the floor pressure relief and reinforcement prevention solution in the embodiment of the disclosure.
Figure 9:
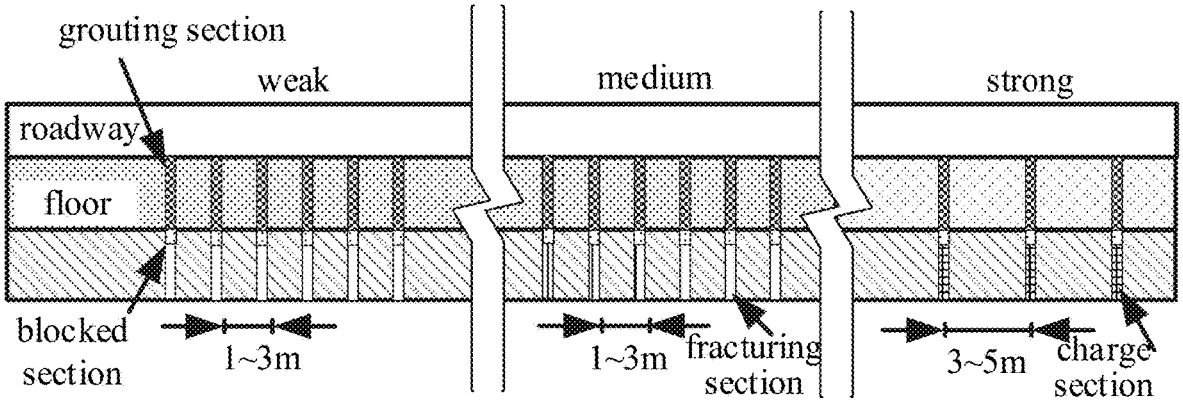
FIG. 9 is a section diagram of the trend of the floor pressure relief and reinforcement prevention solution in the embodiment of the disclosure.
Figure 10:
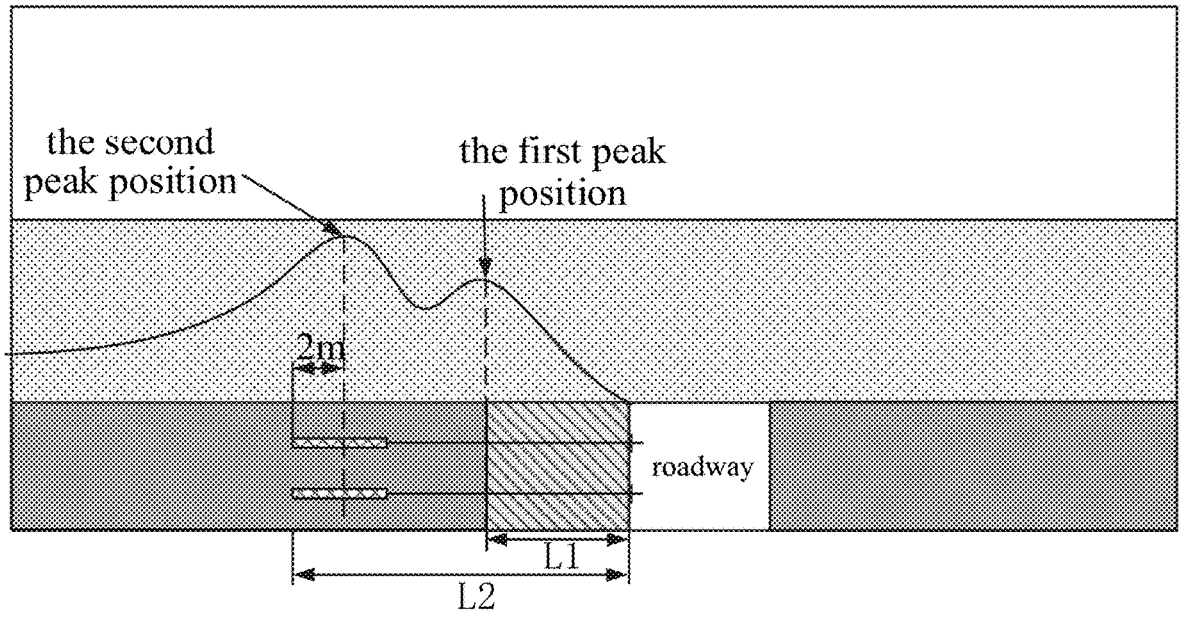
FIG. 10 is a section diagram of the reinforcement and support of the two sides of the roadway in the driving process of the embodiment of the disclosure.
Figure 11:
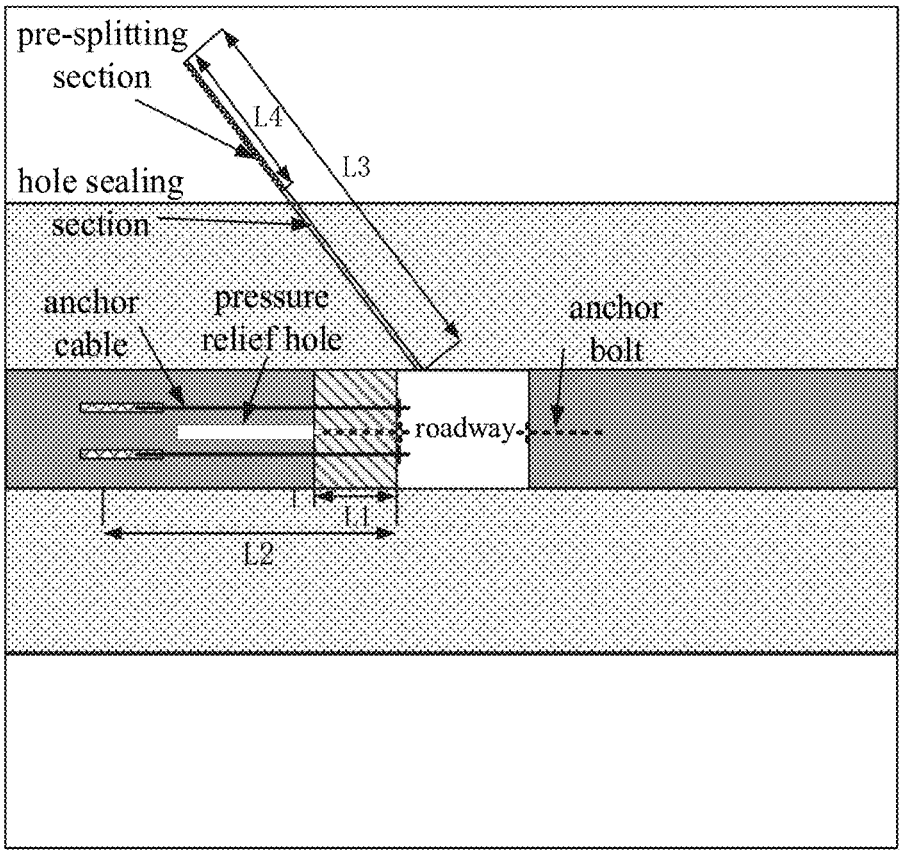
FIG. 11 is a schematic diagram of the joint solution of roadway surrounding rock in the driving process of the embodiment of the disclosure.
Figure 12:
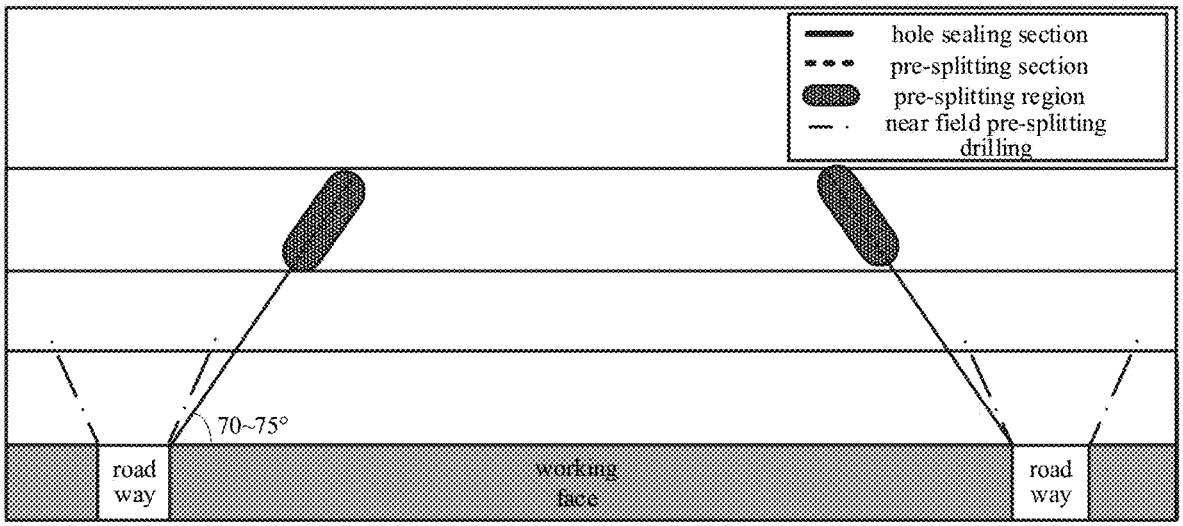
FIG. 12 is a schematic diagram of the pre-splitting of the lateral roof of the working face in the embodiment of the disclosure before mining.
Figure 13:
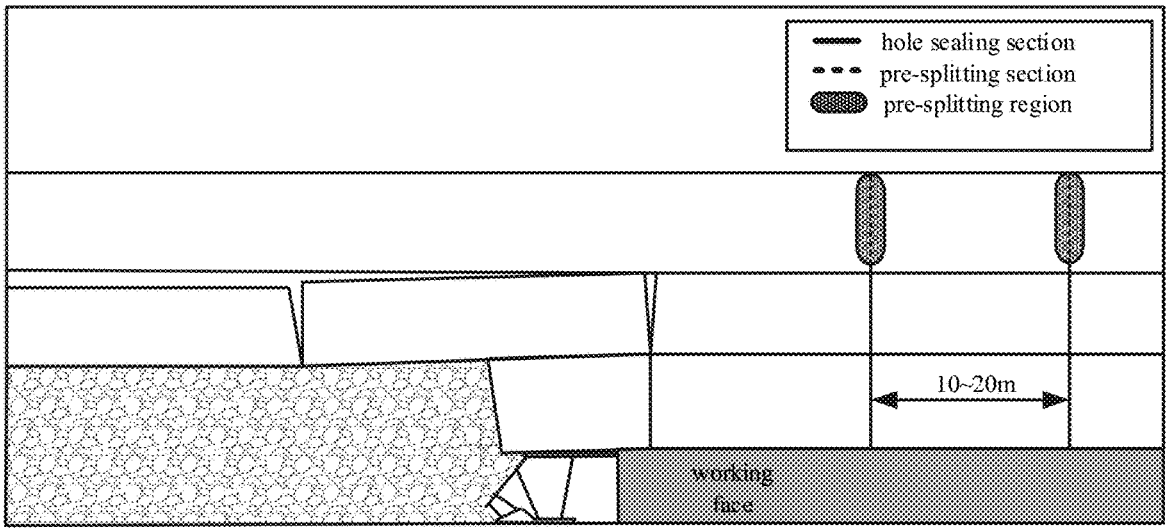
FIG. 13 is a section diagram of the advanced roof pre-splitting in the working face of the embodiment of the disclosure.
Figure 14:
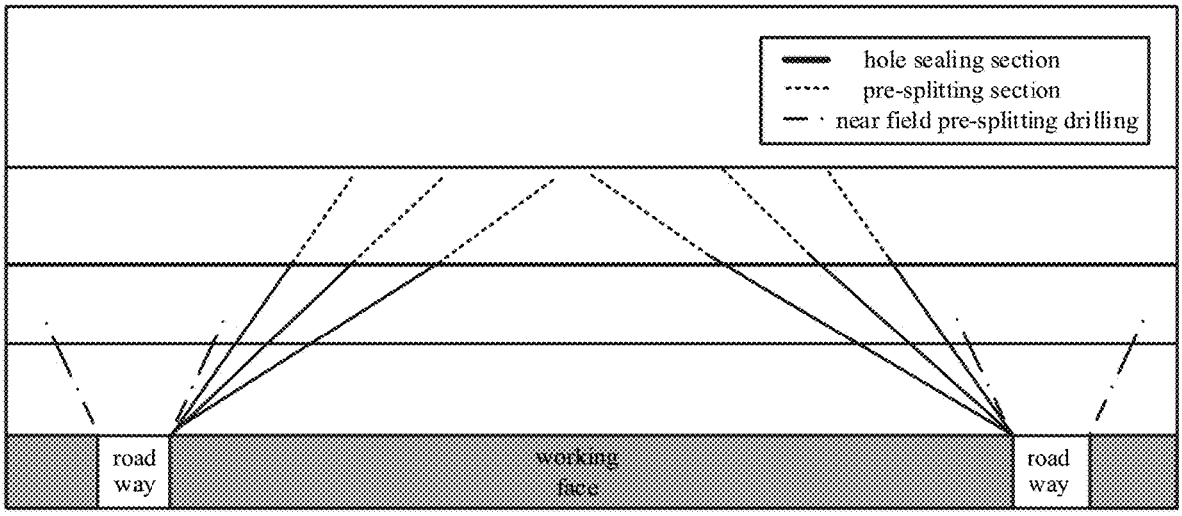
FIG. 14 is a section diagram of the advanced roof pre-splitting in the working face of the embodiment of the disclosure.
Figure 15:
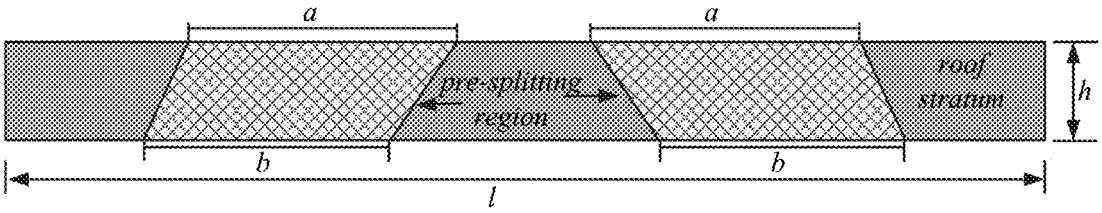
FIG. 15 is a schematic diagram of the pre-split roof end face in the mining process of the embodiment of the disclosure.
Figure 16:
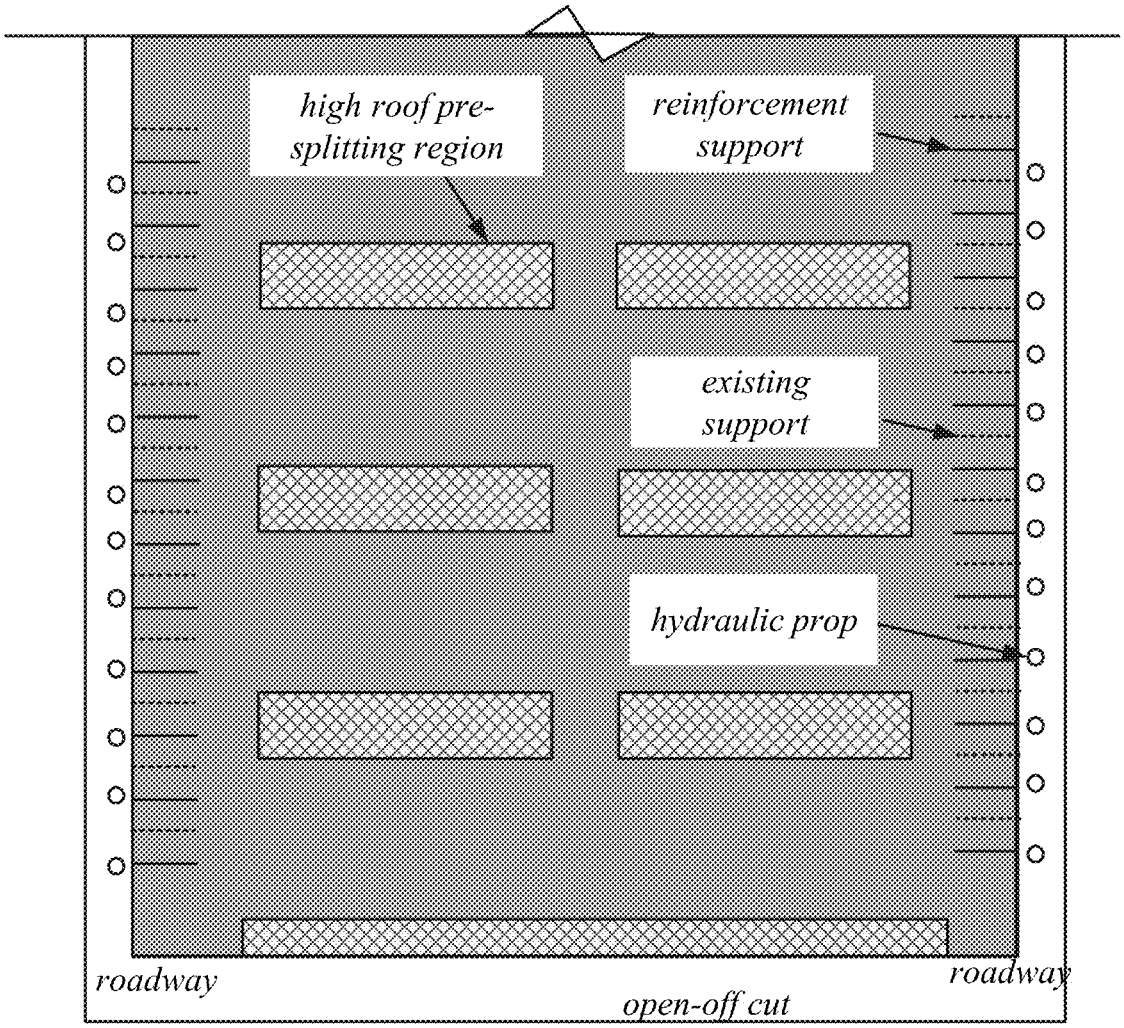
FIG. 16 is a schematic diagram of the reinforcement and support of the advanced roadway in the working face of the embodiment of the disclosure.

A collaborative erosion-control method of releasing-splitting-supporting based on coal mass pressure relief and roof pre-splitting in the present embodiment, as shown in FIG. 1 to FIG. 16, includes the following steps.

Step 1, Driving into the coal seam to release the pressure.

Step 11. During the cyclic driving construction of roadway of the working face, 1-3 pressure relief holes are constructed in the roadway of the driving face according to the rock burst hazard level of the working face with each round of driving construction. The pressure relief holes are 0.5-1.5 m from the floor, the diameter of the pressure relief hole is 100-300 mm, and the depth of which is the sum of the driving planned drilling depth and the distance between the peak value of the bearing pressure of the driving face and the coal wall; the pressure relief holes are constructed in the side of roadway within 20 m behind the driving face, the distance between the adjacent pressure relief holes is 1-3 m, the diameter of the pressure relief hole is 100-300 mm, the depth of the pressure relief hole is 15-45 m, and the height of the pressure relief hole from the floor is 1.0-1.5 m.

Wherein, in the region with weak rock burst hazard level, one pressure relief hole is constructed in the driving face; in the region with medium and strong rock burst hazard level, 2-3 pressure relief holes are constructed in the driving face.

Step 12. In the roadway section in the region with strong rock burst hazard level, the roadway section with the side of roadway of the displacement of 10-20 mm or the roadway section with reduced anchor bolt support strength, the sectional destress drilling is carried out. The distance of the pressure relief holes is 1-3 m, the depth of the pressure relief holes is 15-45 m, the diameter of the pressure relief holes in the 0-5 m section is 70-100 mm, and the diameter of the pressure relief holes in the 5-45 m section is 150-300 mm;

Step 13. Before the next round of construction, a grouting anchor bolt is constructed between the two adjacent pressure relief holes on the side of roadway. The grouting anchor bolt is provided with a stress meter, and the stress meter monitors the stress of the grouting anchor bolt in real time. When the stress of the grouting anchor bolt decreases to 80%, the grouting anchor bolt is replaced.

Step 14. Drill cuttings monitoring is carried out to obtain the drilling powder rate index on two sides of the pressure relief hole of the two sides of the roadway of the coal mass to determine the pressure-relief effect. If the drilling powder rate index is greater than 1.5, it is still has the risk of rock burst, then densify the pressure relief hole to release the pressure on the two sides of the roadway of coal mass again until the drilling powder rate index is less than 1.5. When densifying the pressure relief hole, the drill holes in the two sides of the roadway are perpendicular to the axial direction of the roadway. The diameter of the drill holes is 42-100 mm, the distance between the drill holes is 5-20 m, and the depth of the drill holes is the distance from the peak point of the stress concentration zone to the coal wall.

Step 2. Low roof pre-splitting during driving.

Step 21. In the process of driving roadway, the drill cuttings monitoring is carried on within 100 m from the driving face. The depth of drill hole of the drill cuttings monitoring is not less than 15 m, and the distance between the drill holes is 10-25 m. The equivalent stress contour map and equivalent stress distribution pattern map are drawn according to the amount of pulverized coal corresponding to different drilling depths.

Step 22. Selecting step a or step b to carry out roof pre-splitting construction.

Step a. Blasting pre-splitting.

Step a1. Determining the position of charge section of the roof pre-splitting.

Record that the distance between the equivalent stress peak of the two sides of the roadway in the far distance and the coal wall is $p_x$ meters, draw the peak stress line of the two sides of the roadway on the equivalent stress contour map in step 21, and record the range of the stress peak region of 0.95 $p_x$-$p_x$ meters from the coal wall as a, that is, the stress stability region; record the range 1.0-1.3 m from the peak stress line of the two sides of the roadway as b; the range obtained from the intersection of a and b is the projection of the charge section of the roof pre-splitting on the horizontal, so as to determine the position of the charge section of the roof pre-splitting.

Step a2. Determining the angle of blasting drillhole and the position of target rock layer of pre-splitting roof.

According to the vertical distance h from the bottom of the hole of the charge section to the coal seam and the horizontal distance 1 from the side of roadway, the elevation angle of blasting drillhole is determined;

Then the elevation angle of blasting drillhole is:

$$\theta=\arctan(h/l);$$

In the formula,

In consideration of the influence of dynamic load generated by roof blasting on the stability of coal mass in the side of the roadway, h is taken as 5-7 m;

$$l=(p_x-1.3);$$

Step a3. Arrangement of blasting drillhole.

At the roadway location where the stress stability region is located, the blasting drillhole is carried out from the shoulder angle positions of the two sides of the roadway to the roof. The distance of the blast holes is 5-20 m, and the charge quantity of the blasting drillhole shall achieve the effect of loosening the rock mass without causing the collapse of the rock mass.

Step a4: Detonating the explosive charges in the blasting drillhole.

Step b. Hydraulic pre-splitting.

According to the equivalent stress distribution pattern map in Step 21, the position with the highest amount of pulverized coal is determined as the bearing pressure peak position of the sides of roadway, and hydraulic drillholes is carried out from the shoulder angle positions of the two sides to the roof.

Wherein, the horizontal distance of hydraulic drillholes exceeds 1-2 m over the bearing pressure peak position of the sides of roadway, which is recorded as $l_r$; the vertical distance from the hydraulic drillholes to the coal seam is 3-5 m, which is recorded as $h_r$; then the dip angle of hydraulic drillholes is: $\theta=\arctan(h_r/l_r)$.

The water injection equipment is connected with the hydraulic drillholes through the water injection pipeline. The sealing length of hydraulic drillholes shall not be less than one-third of the hole depth.

The water injection equipment is used to inject water into the hydraulic drillholes. When water seeps out of the roadway roof, the side of roadway or during hydraulic drillholes, the hydraulic pre-splitting is completed.

Step 3: Roadway surrounding rock support and support reinforcement.

Step 31. During the driving process, when the roadway is driven to the section roof and the two sides of the roadway, anchor bolts, anchor bolt cables, ladder beams and steel bands are used for support. The length of the anchor bolts is 1.8-2.4 m, the distance between the anchor bolts is 800-1200 mm, and the row spacing is 800-1200 mm; the anchor bolt cable is installed immediately following the construction of the driving face, with the distance of 800-1200 mm and the row spacing of 800-1200 mm; the beam spacing between the ladder beams is 2000 mm; the length of steel beam is 4000 mm, and the band spacing is 2000 mm.

Step 32. Conducting monitor to the roadway displacement or anchor bolt stress in real time. For roadway sections where the displacement of two sides increases by more than 10% or the anchor bolt stress decreases by more than 10%, the anchor bolt is used for grouting reinforcement within 0-3 m from the coal wall, and the anchor bolt cable is used for reinforcement; for the roadway section where the displacement of the two sides increases by less than 10% or the anchor bolt stress decreases by less than 10%, the anchor bolt is used for grouting reinforcement within 0-3 m from the coal wall.

Step 33. After the roof pre-splitting, in the middle of the two sides of the roadway, the amount of pulverized coal corresponding to different drilling depths is obtained by monitoring the drilling cuttings to draw the equivalent stress distribution pattern map; according to the equivalent stress distribution pattern map, the position where the amount of pulverized coal is reduced is determined as the bearing pressure reduction position of coal seam, the position where the amount of pulverized coal is maximum is determined as the bearing pressure peak position of coal seam, and the second stress peak in the depth of the coal seam is determined as the high stress elastic bearing region of the coal mass.

Step 34. By adopting anchor bolt reinforcement solution to support and reinforce the side of roadway. The length of the anchor bolt ensures that the anchor fixed section is located in the high stress elastic bearing region of the coal mass, and the reinforcement length of the anchor bolt at least exceeds 2.0 m over the bearing pressure peak position of the coal seam.

Step 4: Floor destressing of the roadway;

Step 41. In the roadway section with weak rock burst hazard level, the pressure relief hole with an angle of 45° to the horizontal direction is drilled from the bottom corner of the roadway floor towards the two sides of the roadway. The diameter of pressure relief holes is 70-150 mm, and the row spacing between pressure relief holes is 1-3 m. In the roadway section with medium rock burst hazard level, the pressure relief hole with an angle of 45° to the horizontal direction is drilled from the bottom corner of the roadway floor towards the two sides of the roadway. The diameter of the pressure relief hole is 70-150 mm, and the row spacing between the pressure relief holes is 1-3 m. Hydraulic fracturing is carried out for the weak rock stratum of the floor, and grouting is carried out for the section 1-3 m from the floor in the drillhole. In the roadway section with strong rock burst hazard level, blast holes are drilled from the bottom corner of the roadway floor towards the two sides of the roadway. The diameter of the blast holes is 50-70 mm, and the row spacing between the blast holes is 3-5 m. Blasting treatment is carried out for the weak rock stratum of the floor, and grouting is carried out for the section 1-3 m from the floor in the blast hole.

Step 42. The drilling cuttings monitoring is used as the main method and the microseismic index method as the auxiliary method to detect the floor pressure of the roadway floor; if the destressing is not good after testing, the roadway floor shall be destressed again; specifically, if the difference between the bottom plate ground pressure detection result and the normal value is less than 5%, the pressure relief hole shall be densified; if the difference is greater than 5% and less than 10%, the relief hole shall be densified or the blast hole shall be drilled into the floor between the original pressure relief holes for blasting treatment; if the difference is greater than 10%, the blasting holes shall be drilled into the floor at an interval of 3-5 m between the original pressure relief holes and the middle position of the roadway floor for blasting treatment.

Step 5. High roof pre-splitting before mining.

Step 51. After the mining of the roadway driving is completed and before the mining of the working face, the roof pre-splitting is carried out on the overburden hard roof covered on the front and sides of the open-off cut of the working face; selecting the overburden hard roof with a thickness of more than 5 m and a strength index of D>120 within 100 m from the immediate roof as the rock stratum for pre-splitting;

Step 52. Selecting step c or step d for blast hole layout

Step c. If the working face is a primary working face, drill a blast hole with an angle of 70-75° to the horizontal line from the shoulder angle of the two sides of the roadway towards the direction of the working face; wherein the distance from the end of the blast hole to the coal seam is the sum of the thickness of the rock stratum for pre-splitting and the distance from the roof to the coal seam, and the row spacing of the blast hole is 10-20 m.

Step d. If the working face is goaf on one side, in addition to step c, in the roadway on the side adjacent to the goaf, step e or step f is selected for roof pre-splitting construction:

Step e. Drilling the blast hole with an angle of 70-75° to the horizontal towards the direction of the goaf; the distance from the end of the blast hole to the coal seam is the sum of the thickness of the rock stratum for pre-splitting and the distance from the roof to the coal seam, and the row spacing of the blast hole is 10-20 m.

Step f. Using hydraulic fracturing to pre-split the roof at the side of the coal pillar in the goaf. The diameter of the hydraulic drillholes is 56 mm, the length of the hydraulic drillholes is 30 m, the spacing of the hydraulic drillholes is 15-30 m, the angle between the horizontal projection of the hydraulic drillholes and the coal wall is 75°, and the elevation angle of the hydraulic drillholes is 50°; the water injection equipment is connected with the hydraulic drillholes through the water injection pipeline, and the sealing length of hydraulic drillholes shall not be less than one-third of the hole depth. When water seeps out of the roadway roof, roadway side or hydraulic drillholes, the hydraulic pre-splitting is completed.

Step 6. The pressure relief and support of the advanced roadway surrounding rock during the mining process of the working face.

Step 61. Constructing the pressure relief holes in the coal mass within at least 200 m of the advance working face on two sides of the roadway. The pressure relief hole is constructed towards the coal mass at the open-off cut of the working face, and the depth of the pressure relief hole is the sum of the planned drilling depth of the working face and the distance from the bearing pressure peak position to the coal wall.

Step 62. Roof pre-splitting during the mining process of the working face.

In the mining process of the working face, the overburden hard roof breaks in front of the work and releases huge strain energy, especially when the hard roof breaks for the first time, the strain energy released by the hard roof fracture is more than 10 times of the roof energy after its fracture. In order to reduce the fracture energy release of the overburden hard roof, within the range of 100 m in advance of the working face, blast holes are constructed at an interval of 20-30 m from the shoulder angle of the roadway to the coal mass to conduct blasting pre-splitting. The blast holes are arranged in a fan pattern and the range of elevation angle of the blast holes is 30-70°. After roof pre-splitting, a large amount of elastic strain energy is released from the roof, and its integrity is destroyed, which weakens its breaking conditions and greatly reduces the amount of energy released by the fracture in the mining process.

Step 63. Calculation of roof breaking impact energy

The impact energy generated by roof breaking is:

$$\Delta U_w = \frac{q^2 L^5}{8k^3 EI};$$

In the formula, q is the uniformly distributed load of the overburden rock stratum; L is the span of roof stratum, which is approximately the pre-splitting interval; k is the weakening coefficient of the inertia moment of the roof end face, wherein $$k = \frac{a+b}{l},$$

a and b are the length of the pre-splitting zone at the upper and lower boundaries of the roof respectively, and l is the length of the working face inclination; E is the elastic modulus of roof stratum; I is the inertia moment of the roof end face without pre-splitting.

Step 64. Advance support of roof and two sides of the roadway during the mining process of the working face.

The roof of the roadway adopts hydraulic props for advance support, and the two sides of the roadway adopt anchor bolts for advance reinforcement support;

$$P_z > \frac{\alpha \Delta U_w - an_g \int_{P_{g0}}^{P_{gm}} P_g dl_g - an_s \int_{P_{s0}}^{P_{sm}} P_s dl_s}{bnl_i};$$

In the formula, $P_z$ is the support strength of a single hydraulic prop in advance of the working face, kN/m; a is the energy attenuation coefficient; a is the advance support range of roadway, m; b is the roadway width, m; n is the total number of hydraulic props in the advance region; $n_g$ and $n_s$ are the number of existing anchor bolts and anchor cables on the roof of the roadway per unit length; $l_i$ is the maximum compressed amount of a single hydraulic prop; $P_g$ and $P_s$ are the supporting forces of the existing roof anchor bolts and anchor cables; $P_{gm}$ and $P_s$ are the breaking forces of the existing roof anchor bolts and anchor cables; $P_{g0}$ and $P_{s0}$ are the current support forces of existing roof anchor bolts and anchor cables.

$$P_m > \frac{\alpha \Delta U_w - an_g \int_{P_{g0}}^{P_{gm}} P_g dl_g - an_s \int_{P_{s0}}^{P_{sm}} P_s dl_s}{bnl_i};$$

In the formula, $P_m$ is the support strength of single anchor bolt ahead of the working face, kN/m; $n_g$ and $n_s$ are the number of existing anchor bolts and anchor cables at the side of the roadway per unit length; n is the number of anchor bolts at the side of the roadway per unit length; $P_g$ and $P_s$ are the supporting forces of the existing anchor bolts and anchor cables on the side of the roadway; $P_{gm}$ and $P_s$ are the breaking forces of the existing anchor bolts and cables in the side of the roadway; $P_{g0}$ and $P_{s0}$ are the current support forces of existing anchor bolts and anchor cables in the side of the roadway.

Wherein, the comprehensive index method is used to determine the rock burst hazard level. If the rock burst hazard index is less than 0.25, it is defined as no rock burst hazard; if the rock burst hazard index is greater than or equal to 0.25 and less than 0.5, it is defined as weak; if the rock burst hazard index is greater than or equal to 0.5 and less than or equal to 0.75, it is defined as the medium rock burst hazard level; If the rock burst hazard index is greater than 0.75, it is defined as the strong rock burst hazard level.

Preferably, the drill cuttings monitoring process is as follows:

The drillholes which are vertical to the coal mass in the side of the roadway with a diameter of 40-50 mm is drilled, the amount of pulverized coal drilled at each set depth is collected, weighed and recorded.

So far, this embodiment has been described in detail in combination with the attached drawings. According to the above description, those skilled in the art should have a clear understanding of a collaborative erosion-control method of releasing-splitting-supporting based on coal mass pressure relief and roof pre-splitting provided by the present disclosure. The disclosure directly presplits the rock stratum of different targets, releases the roof strain energy, and depressurizes the two sides of the roadway, reducing the stress concentration coefficient of the two sides of the coal, which is conducive to the roof collapse in the mining process. Compared with the coal seam blasting method, the roof pre-splitting method of the low near-field roof can ensure the bearing capacity of the coal mass, at the same time, make the coal seam stress transfer to a deeper depth, give play to the characteristics of the high bearing capacity of the deep coal mass, and effectively reduce the probability of rock burst. The disclosure carries out the open-off cut position and lateral roof pre-splitting in the roadway before mining, while preventing the rock burst of the driving face, it plays a beneficial role in the collapse of the hard roof during the mining process of the working face, and can effectively prevent the large region roof collapse from causing strong impact energy. At the same time, the roof pre-splitting method is in advance of the mining of the working face in time, avoiding the superposition of engineering disturbance and mining disturbance of the roof pre-splitting, and significantly reducing the control work of rock burst disaster prevention measures in the mining process. On the basis of sectional drilling and pressure relief for the two sides of the coal mass, the disclosure carries out roof pre-splitting, which can fully reduce the stress concentration of the two sides of the coal mass, release the strain energy stored in the coal mass, and ensure the support capacity of the anchor bolts and the integrity and bearing capacity of the coal mass near the roadway. By monitoring the stress distribution of the coal seam, using the pressure relief technology to transfer the bearing pressure and the high strength of the deep coal body, the disclosure anchors the two sides of the coal mass, which can achieve better anchoring effect and improve the impact resistance of the two sides of the coal mass. The equivalent end face inertia moment weakening coefficient is used to calculate the impact energy when the pre-split roof collapses, and advance support is carried out for the working face roadway. The disclosure integrates the existing technical elements to control the rock burst risk factors of surrounding rock roof and coal seam, and has the characteristics of simple and easy operation and convenient construction.

In the description of the present invention, it should be understood that if orientation or position relations indicated by the terms such as "upper," "lower," "left," "right," "front," "back," and the like are based on the orientation or position relations shown in the drawings, and the terms are intended only to facilitate the description of the present invention and simplify the description, rather than indicating or implying that the apparatus or element referred to must have a particular orientation and be constructed and operated in the particular orientation, and therefore cannot be construed as a limitation on the present invention.

The above are merely preferred embodiments of the present invention and are not intended to limit the present invention. The present invention may be subject to changes and variations for those skilled in the art. Any modifications, equivalent replacements, and improvements made within the spirit and principles of the present invention shall all be encompassed in the protection scope of the present invention.

What is claimed is:

1. A collaborative erosion-control method of releasing-splitting-supporting based on coal mass pressure relief and roof pre-splitting, comprising the following steps:

step 1, driving into a coal seam to release pressure;

step 11, constructing 1-3 pressure relief holes in a roadway of a driving face according to a rock burst hazard level of a working face with each round of driving construction during a cyclic driving construction of a roadway of the working face, wherein the pressure relief holes are 0.5-1.5 m from a floor, a diameter of the pressure relief holes is 100-300 mm, and a depth of which is a sum of a driving planned drilling depth and a distance between a peak value of bearing pressure of the driving face and a coal wall; the pressure relief holes are constructed in a side of roadway within 20 m behind the driving face, a distance between the adjacent pressure relief holes is 1-3 m, the diameter of the pressure relief holes is 100-300 mm, a depth of the pressure relief holes is 15-45 m, and a height of the pressure relief holes from the floor is 1.0-1.5 m;

wherein, in a region with weak rock burst hazard level, one pressure relief hole is constructed in the driving face; in a region with medium and strong rock burst hazard level, 2-3 pressure relief holes are constructed in the driving face;

a comprehensive index method is used to determine the rock burst hazard level; if the rock burst hazard index is less than 0.25, it is defined as no rock burst hazard; if the rock burst hazard index is greater than or equal to 0.25 and less than 0.5, it is defined as the weak rock burst hazard level; if the rock burst hazard index is greater than or equal to 0.5 and less than or equal to 0.75, it is defined as the medium rock burst hazard level; if the rock burst hazard index is greater than 0.75, it is defined as the strong rock burst hazard level;

step 12, carrying out a sectional destress drilling in a roadway section in a region with strong rock burst hazard level, a roadway section with the side of the roadway of a displacement of 10-20 mm or a roadway section with reduced anchor bolt support strength, wherein the distance of the pressure relief holes is 1-3 m, the depth of the pressure relief holes is 15-45 m, a diameter of the pressure relief holes in the 0-5 m section is 70-100 mm, and a diameter of the pressure relief holes in a 5-45 m section is 150-300 mm;

step 13, constructing a grouting anchor bolt between two adjacent pressure relief holes on the side of the roadway before a next round of construction, wherein the grouting anchor bolt is provided with a stress meter, and the stress meter is configured to monitor stress of the grouting anchor bolt in real time; replacing the grouting anchor bolt when the stress of the grouting anchor bolt decreases to 80%;

step 14, carrying out a drill cuttings monitoring to obtain a drilling powder rate index on two sides of a pressure relief hole of two sides of a roadway of a coal mass to determine a pressure-relief effect; if the drilling powder rate index is greater than 1.5, it still has a risk of rock burst, then densifying the pressure relief hole to release pressure on the two sides of the roadway of the coal mass again until the drilling powder rate index is less than 1.5, wherein drill holes in the two sides of the roadway are perpendicular to an axial direction of the roadway when densifying the pressure relief hole; a diameter of the drill holes is 42-100 mm, a distance between the drill holes is 5-20 m, and a depth of the drill holes is the distance from a peak point of stress concentration zone to the coal wall;

step 2, low roof pre-splitting during driving process;

step 21, carrying the drill cuttings monitoring on within 100 m from the driving face in the driving process of the roadway, wherein a depth of drill holes of the drill cuttings monitoring is not less than 15 m, and a distance between the drill holes is 10-25 m; drawing an equivalent stress contour map and an equivalent stress distribution pattern map according to an amount of pulverized coal corresponding to different drilling depths;

step 22, selecting step a or step b to carry out roof pre-splitting construction;

step a, blasting pre-splitting;

step a1, determining a position of charge section of the roof pre-splitting;

recording that a distance between a equivalent stress peak of the two sides of the roadway in far distance and the coal wall is $p_x$ meters, drawing a peak stress line of the two sides of the roadway on a equivalent stress contour map in step 21, and recording a range of stress peak region of 0.95 $p_x$-$p_x$ meters from the coal wall as a, that is, a stress stability region; recording a range 1.0-1.3 m from the peak stress line of the two sides of the roadway as b; an intersection range obtained from a and b is a projection of the charge section of the roof pre-splitting on a horizontal plane, so as to determine the position of the charge section of the roof pre-splitting;

step a2, determining an angle of blast holes and a position of a target rock layer of a pre-splitting roof;

determining an elevation angle of the blast holes according to a vertical distance h from a bottom of a hole of the charge section to the coal seam and a horizontal distance 1 from the side of the roadway;

then calculating the elevation angle of blasting drillhole by the formula:

$$\theta=\arctan(h/l);$$

in the formula, in consideration of an influence of dynamic load generated by roof blasting on a stability of the coal mass in the side of the roadway, h is taken as 5-7 m;

$$l=(p_x-1.3);$$

step a3, arranging of the blast holes;

constructing the blast holes from shoulder angle positions of the two sides of the roadway to the roof at a roadway location where the stress stability region is located, wherein a distance of the blast holes is 5-20 m, and a charge quantity of the blast holes achieves an effect of loosening rock mass without causing a collapse of the rock mass;

step a4, detonating explosive charges in the blasting drillhole;

step b, hydraulic pre-splitting;

determining a position with a highest amount of the pulverized coal as a bearing pressure peak position of the sides of the roadway according to the equivalent stress distribution pattern map in step 21, and constructing hydraulic drillholes from the shoulder angle positions of the two sides of the roadway to the roof;

wherein, a horizontal distance of the hydraulic drillholes exceeds 1-2 m over the bearing pressure peak position of the sides of the roadway, recorded as $l_r$; a vertical distance from the hydraulic drillholes to the coal seam is 3-5 m, recorded as $h_r$; then a dip angle of the hydraulic drillholes is: $\theta=\arctan(h_r/l_r)$;

water injection equipment is connected with the hydraulic drillholes through a water injection pipeline;

injecting water, by the water injection equipment, into the hydraulic drillholes; when water seeps out of the roadway roof or the side of the roadway, or when water seeps out during the hydraulic drillholes, the hydraulic pre-splitting is completed;

step 3, supporting of roadway surrounding rock and support reinforcement;

step 31, using anchor bolts, anchor bolt cables, ladder beams and steel bands for support when the roadway is driven to a section roof and the two sides of the roadway during the driving process; wherein a length of the anchor bolts is 1.8-2.4 m, a distance between the anchor bolts is 800-1200 mm, and a row spacing of the anchor bolts is 800-1200 mm; the anchor bolt cable is installed immediately following a construction of the driving face, with a distance of 800-1200 mm and a row spacing of 800-1200 mm; a beam spacing between the ladder beams is 2000 mm; a length of steel beam is 4000 mm, and a band spacing is 2000 mm;

step 32, conducting a real-time monitoring to a roadway displacement or anchor bolt stress, wherein for roadway section where the roadway displacement of the two sides increases by more than 10% or stress of the anchor bolts decreases by more than 10%, the anchor bolts are used for grouting reinforcement within 0-3 m from the coal wall, and the anchor bolt cables are used for reinforcement; for the roadway section where the roadway displacement of the two sides increases by less than 10% or the stress of the anchor bolts decreases by less than 10%, the anchor bolts are used for grouting reinforcement within 0-3 m from the coal wall;

step 33, after the roof pre-splitting, obtaining the amount of the pulverized coal corresponding to different drilling depths by monitoring the drilling cuttings in a middle of the two sides of the roadway to draw the equivalent stress distribution pattern map; according to the equivalent stress distribution pattern map, determining a position where the amount of the pulverized coal is reduced as a bearing pressure reduction position of the coal seam, determining a position where the amount of the pulverized coal is maximum as a bearing pressure peak position of the coal seam, and determining a second stress peak in the depth of the coal seam as a high stress elastic bearing region of the coal mass;

step 34, supporting and reinforcing the two sides of the roadway by adopting the anchor bolts for reinforcement, wherein a length of the anchor bolts ensures that the anchor fixed section is located in the high stress elastic bearing region of the coal mass, and a reinforcement length of the anchor bolts at least exceeds 2.0 m over the bearing pressure peak position of the coal seam;

step 4, floor destressing of the roadway;

step 41, in the roadway section with the weak rock burst hazard level, drilling the pressure relief holes with an angle of 45° to a horizontal direction from a bottom corner of a roadway floor towards the two sides of the roadway, the diameter of the pressure relief holes is 70-150 mm, and the row spacing between the pressure relief holes is 1-3 m; in the roadway section with the medium rock burst hazard level, drilling the pressure relief holes with the angle of 45° to the horizontal direction from the bottom corner of the roadway floor towards the two sides of the roadway, the diameter of the pressure relief holes is 70-150 mm, and the row spacing between the pressure relief holes is 1-3 m; carrying out a hydraulic fracturing for weak rock stratum of the roadway floor, and carrying out grouting for the section 1-3 m from the roadway floor in the drillholes; in the roadway section with the strong rock burst hazard level, drilling blast holes from the bottom corner of the roadway floor towards the two sides of the roadway, the diameter of the blast holes is 50-70 mm, and the row spacing between the blast holes is 3-5 m; carrying out blasting on the weak rock stratum of the roadway floor, and carrying out grouting on the section 1-3 m from the roadway floor in the blast holes;

step 42, using the drilling cuttings monitoring as a main method and a microseismic index method as an auxiliary method to detect the floor pressure of the roadway floor, wherein if destressing is not good after testing, the roadway floor is destressed again; specifically, if the difference between a floor ground pressure detection result and a normal value is less than 5%, the pressure relief holes are densified; if the difference is greater than 5% and less than 10%, the pressure relief holes are densified or the blast holes are drilled into the roadway floor between the original pressure relief holes for blasting; if the difference is greater than 10%, drilling the blast holes into the roadway floor at an interval of 3-5 m between the original pressure relief holes and a middle position of the roadway floor for blasting;

step 5, high roof pre-splitting before mining;

step 51, after the mining of the roadway driving is completed and before the mining of the working face, carrying out the roof pre-splitting on an overburden hard roof covered on the front and sides of an open-off cut of the working face; selecting the overburden hard roof with a thickness of more than 5 m and a strength index of D>120 within 100 m from an immediate roof as the rock stratum for pre-splitting;

step 52, selecting step c or step d for layout of the blast holes;

step c, if the working face is a primary working face, drill a blast hole with an angle of 70-75° to the horizontal line from the shoulder angle of the two sides of the roadway towards the direction of the working face; wherein the distance from the end of the blast hole to the coal seam is the sum of the thickness of the rock stratum for pre-splitting and the distance from the roof to the coal seam, and the row spacing of the blast hole is 10-20 m;

step d, if the working face is goaf on one side, in addition to step c, in the roadway on the side adjacent to the goaf, selecting step e or step f for roof pre-splitting construction;

step e, drilling the blast holes with an angle of 70-75° to the horizontal towards a direction of the goaf; a distance from an end of the blast hole to the coal seam is the sum of the thickness of the rock stratum for pre-splitting and a distance from the roof to the coal seam, and the row spacing of the blast holes is 10-20 m;

step f, using the hydraulic fracturing to pre-split the roof at a side of a coal pillar in the goaf; a diameter of the hydraulic drillholes is 56 mm, a length of the hydraulic drillholes is 30 m, a spacing of the hydraulic drillholes is 15-30 m, an angle between the horizontal projection of the hydraulic drillholes and the coal wall is 75°, and an elevation angle of the hydraulic drillholes is 50°, wherein the water injection equipment is connected with the hydraulic drillholes through the water injection pipeline, and the water injection equipment is used to inject water into the hydraulic drillholes; the hydraulic pre-splitting is completed when water seeps out of the roadway roof, the roadway side or the hydraulic drillholes;

step 6, destressing and supporting of the advanced roadway surrounding rock during the mining process of the working face;

step 61, constructing the pressure relief holes in the coal mass within at least 200 m of the advance working face on the two sides of the roadway; constructing the pressure relief hole towards the coal mass at the open-off cut of the working face, wherein the depth of the pressure relief holes is the sum of a planned drilling depth of the working face and a distance from the bearing pressure peak position to the coal wall;

step 62, roof pre-splitting during the mining process of the working face;

in the mining process of the working face, in order to reduce fracture energy release of the overburden hard roof, within the range of 100 m in advance of the working face, constructing blast holes at an interval of 20-30 m from the shoulder angle of the roadway to the coal mass to conduct blasting pre-splitting; wherein the blast holes are arranged in a fan pattern and the range of the elevation angle of the blast holes is 30-70°;

step 63, calculating of roof breaking impact energy the impact energy generated by the roof breaking is:

$$\Delta U_w = \frac{q^2 L^5}{8k^3 EI};$$

in the formula, q is an uniformly distributed load of the overburden rock stratum; L is a span of roof stratum, which is an approximately pre-splitting interval; k is a weakening coefficient of the inertia moment of roof end face, wherein $$k = \frac{a+b}{l},$$

a and b are lengths of a pre-splitting zone at upper and lower boundaries of the roof respectively, and l is a length of the working face inclination; E is an elastic modulus of the roof stratum; I is an inertia moment of the end face without pre-splitting;

step 64, advance supporting of the roof and the two sides of the roadway during the mining process of the working face;

adopting hydraulic props for the advance supporting of the roadway roof, and adopting the anchor bolts for advance reinforcement support of the two sides of the roadway;

$$P_z > \frac{\alpha \Delta U_w - a n_g \int_{P_{g0}}^{P_{gm}} P_g dl_g - a n_s \int_{P_{s0}}^{P_{sm}} P_s dl_s}{b n l_i};$$

in the formula, $P_z$ is a support strength of a single hydraulic prop in advance of the working face, kN/m; α is an energy attenuation coefficient; α is an advance support range of the roadway, m; b is a roadway width, m; n is a total number of the hydraulic props in the advance region; $n_g$ and $n_s$ are the number of existing anchor bolts and anchor cables on the roof of the roadway per unit length; $l_i$ is the maximum compressed amount of a single hydraulic prop; $P_g$ and $P_s$ are supporting forces of the existing anchor bolts and anchor cables on the roof of the roadway; $P_{gm}$ and $P_s$ are breaking forces of the existing anchor bolts and anchor cables on the roof of the roadway; $P_{g0}$ and $P_{s0}$ are current support forces of the existing anchor bolts and anchor cables on the roof of the roadway;

$$P_m > \frac{\alpha \Delta U_w - a n_g \int_{P_{g0}}^{P_{gm}} P_g dl_g - a n_s \int_{P_{s0}}^{P_{sm}} P_s dl_s}{b n l_i};$$

in the formula, $P_m$ is a support strength of single anchor bolt in advance of the working face, kN/m; $n_g$ and $n_s$ are the number of the existing anchor bolts and anchor cables at the sides of the roadway per unit length; n is the number of the anchor bolts at the sides of the roadway per unit length; $P_g$ and $P_s$ are the supporting forces of the existing anchor bolts and anchor cables on the sides of the roadway; $P_{gm}$ and $P_{sm}$ are the breaking forces of the existing anchor bolts and cables in the sides of the roadway; $P_{g0}$ and $P_{s0}$ are the current support forces of existing anchor bolts and anchor cables in the sides of the roadway.

2. The collaborative erosion-control method of releasing-splitting-supporting based on coal mass pressure relief and roof pre-splitting of claim 1, wherein a process of the drill cuttings monitoring is as follows:

drilling the drillholes with a diameter of 40-50 mm and vertical to the coal mass in the side of the roadway, collecting the amount of pulverized coal drilled at each set depth, weighing and recording the amount of pulverized coal collected.

* * * * *